US007361062B2

(12) United States Patent
Long et al.

(10) Patent No.: US 7,361,062 B2
(45) Date of Patent: Apr. 22, 2008

(54) ELECTRICAL CONNECTOR WITH IMPROVED SOLDERING CHARACTERISTIC TO BE MOUNTED ON A PRINTED CIRCUIT BOARD

(75) Inventors: Ji-En Long, ShenZhen (CN); Wei-Nan Kuo, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/647,027

(22) Filed: Dec. 27, 2006

(65) Prior Publication Data

US 2007/0149062 A1 Jun. 28, 2007

(30) Foreign Application Priority Data

Dec. 28, 2005 (TW) ..... 200520140516

(51) Int. Cl.
*H01R 24/04* (2006.01)

(52) U.S. Cl. ..... 439/668

(58) Field of Classification Search ..... 439/668, 439/63

See application file for complete search history.

(56) References Cited

U.S. PATENT DOCUMENTS 6,000,970 A * 12/1999 Wu ..... 439/669
6,923,687 B2 8/2005 Wang
7,081,023 B2 7/2006 Zhang
2005/0245104 A1* 11/2005 Nkagawa et al. ..... 439/63

* cited by examiner

*Primary Examiner*—Ross Gushi
(74) *Attorney, Agent, or Firm*—Wei Te Chung

(57) ABSTRACT

An electrical connector (100) includes an insulative housing (1) for receiving a number of contacts (2). The insulative housing has a base (11) extending in a longitudinal direction and a mating portion (12) protruding forwardly from the base. The base (11) defines a slot (141) from an intermediate position thereof and extending forwardly through the mating portion (12). The mating portion (12) defines a receiving hole (10) extending into the base (11). The receiving hole (10) is in communication with the slot (141). The slot (141) can counteract a deformation of the insulative housing to ensure the soldering tails (213, 223, 233, 243, 253, 262) of the contacts coplanar with one another, thereby ensuring the contacts to be wonderfully surface mounted on a PCB.

20 Claims, 5 Drawing Sheets

ELECTRICAL CONNECTOR WITH IMPROVED SOLDERING CHARACTERISTIC TO BE MOUNTED ON A PRINTED CIRCUIT BOARD

BACKGROUND OF THE INVENTION

1. Field of the Invention

This invention generally relates to an electrical connector, and more particularly to an electrical connector with improved soldering characteristic to be mounted on a print circuit board (PCB).

2. Description of the Prior Art

U.S. Pat. No. 6,690,801 B2, discloses a conventional electrical connector which includes an insulative housing and a plurality of contacts assembled to the insulative housing. The insulative housing has a top wall, a mounting wall and a pair of side walls connecting the top and mounting walls. The insulative housing further defines a longitudinal hole therethrough for receiving a mating plug. The contacts each have a soldering portion coplanar with one another to be surface mounted on a PCB. However, with a trend that electrical devices have lower profile, the electrical connectors mounted in the electrical devices are accordingly smaller and smaller. Meanwhile, the insulative housing becomes so thin that it may easily be warpaged, especially the side walls. As a result, the soldering portions of the contacts cannot be coplanar with one another anymore due to the deformation of the insulative housing and the contacts retained in the insulative housing can't be wonderfully mounted on the PCB to ensure a reliable signal transmission.

Hence, it is desired to have an electrical connector solving the problem above.

BRIEF SUMMARY OF THE INVENTION

Accordingly, an object of the present invention is to provide an electrical connector with an improved insulative housing to ensure the surface mounting of the contacts on a PCB.

In order to attain the objective above, an electrical connector mounted on a PCB comprises an insulative housing and a plurality of contacts retained in the insulative housing. The insulative housing comprises a base extending along a longitudinal direction and a mating portion protruding forwardly from a front surface of the base. The mating portion defines a receiving hole extending into the base for receiving the plug. The base has a mounting wall facing to the PCB with a slot defined therethrough in another direction perpendicular to the longitudinal direction. The slot extends forwardly substantially along the longitudinal direction from a position of the mounting wall. The slot extends through the mating portion and in communication with the receiving hole. The contacts have a plurality of contact portions extending into the receiving hole. With this arrangement, the slot can counteract a deformation of the insulative housing to ensure the soldering tails of the contacts coplanar with one another, thereby facilitating the contacts to be mounted on the PCB.

Other objects, advantages and novel features of the invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE INVENTION

Reference will now be made in detail to the preferred embodiment of the present invention.

Figure 1:
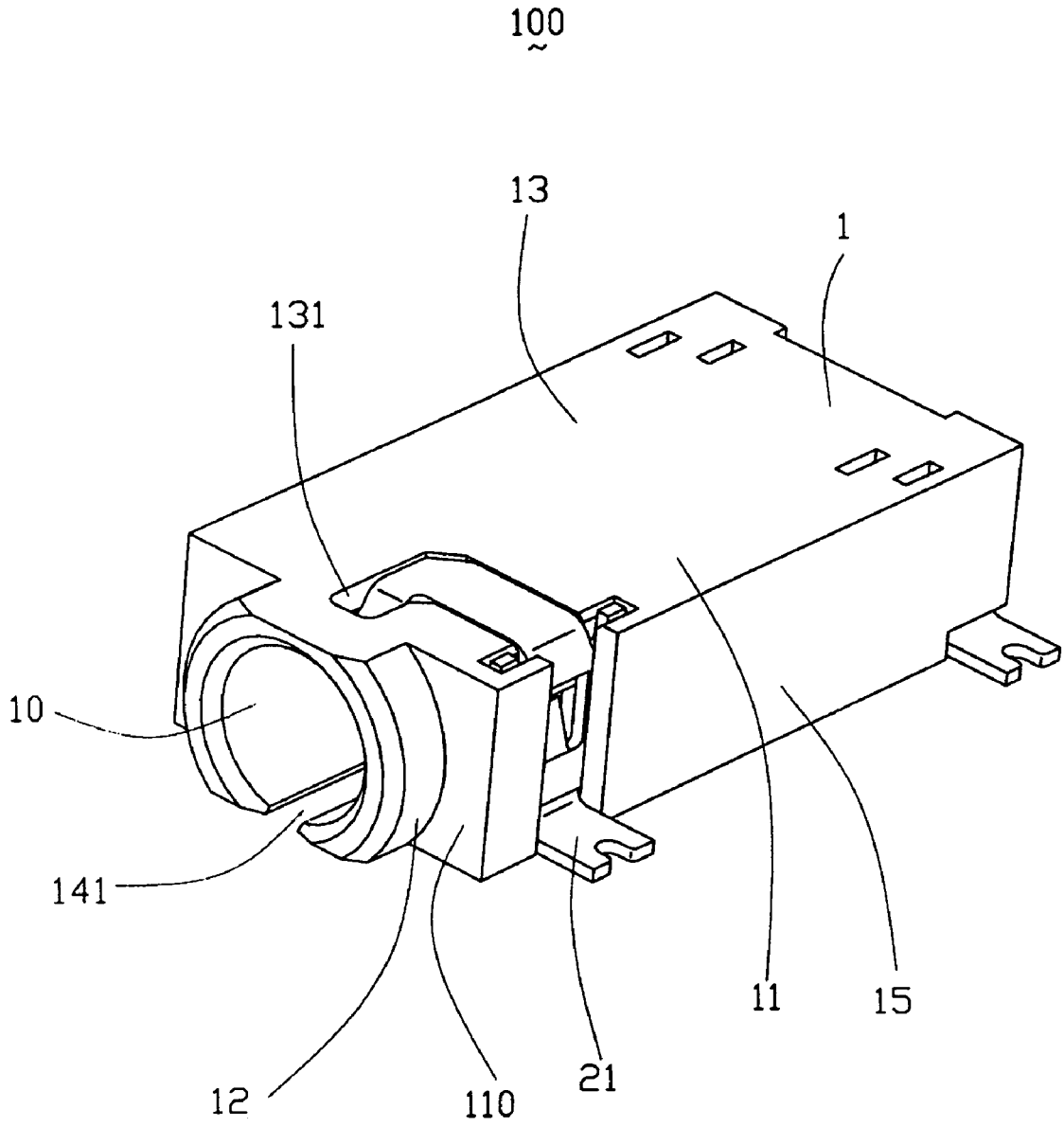
FIG. 1 is a perspective view of an electrical connector according to an embodiment of the present invention.
Figure 2:
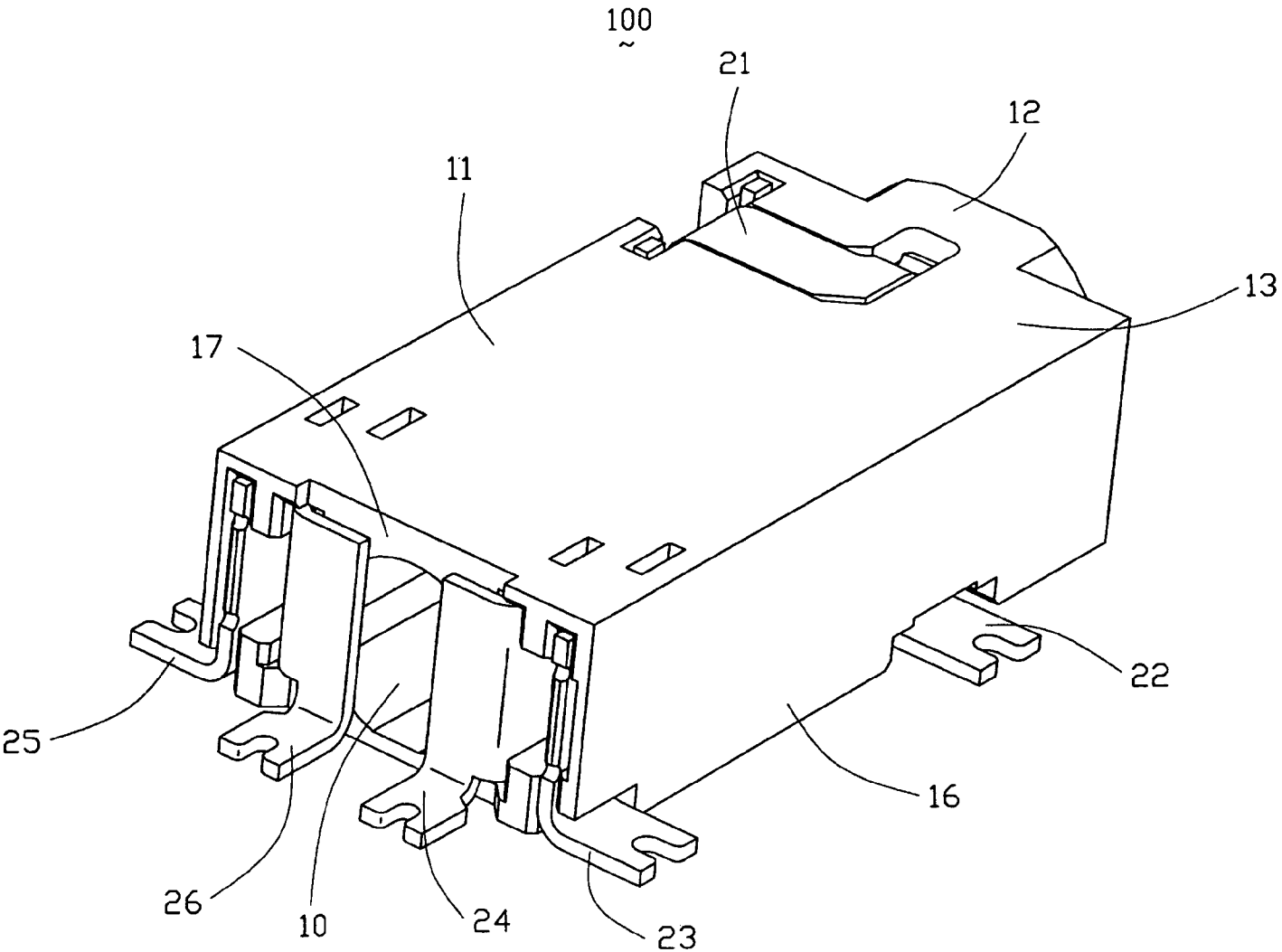
FIG. 2 is another perspective view of the electrical connector shown in FIG. 1.
Figure 3:
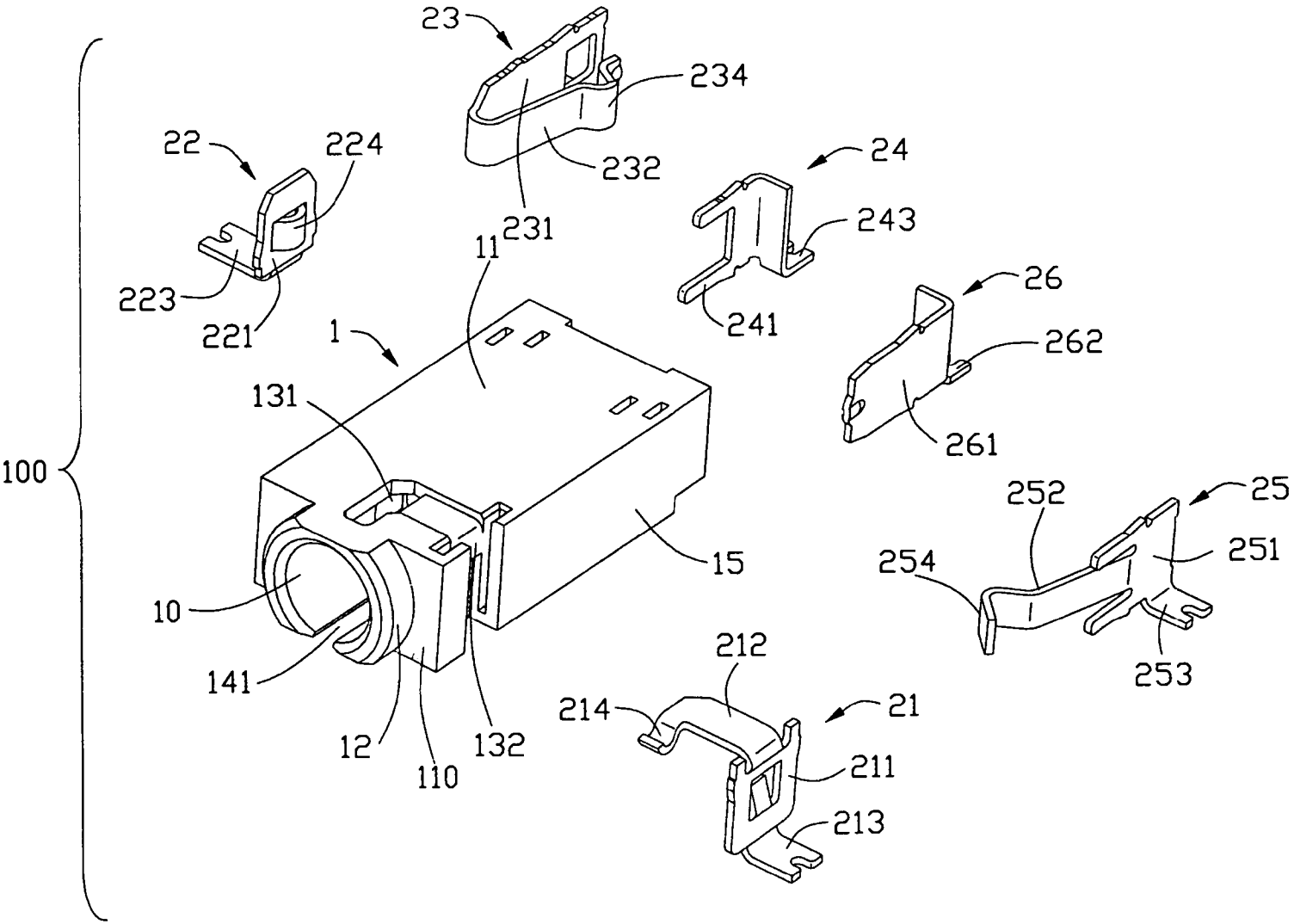
FIG. 3 is an exploded view of the electrical connector according to an embodiment of the present invention.
Figure 4:
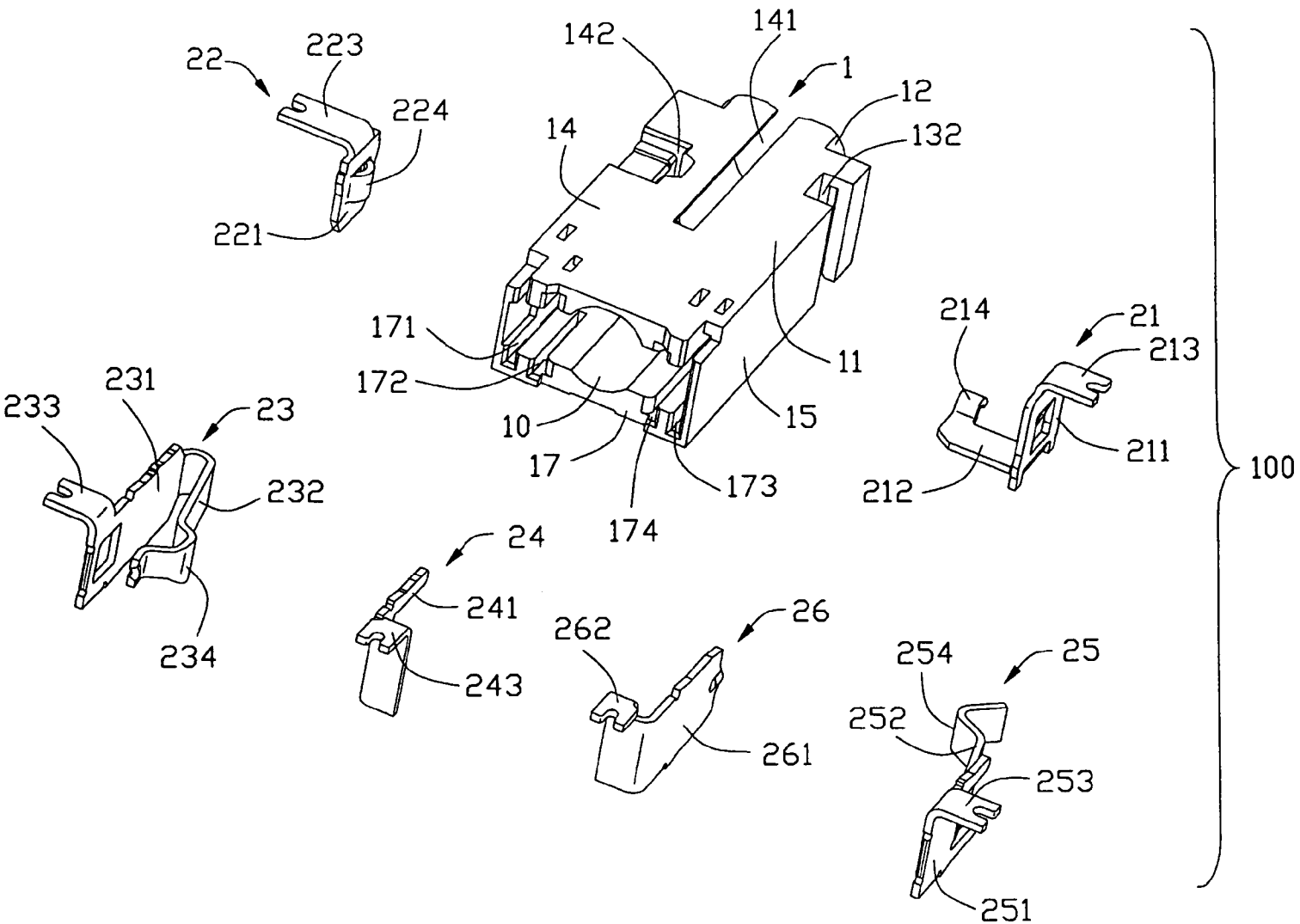
FIG. 4 is similar to FIG. 3, but viewed from another aspect.
Figure 5:
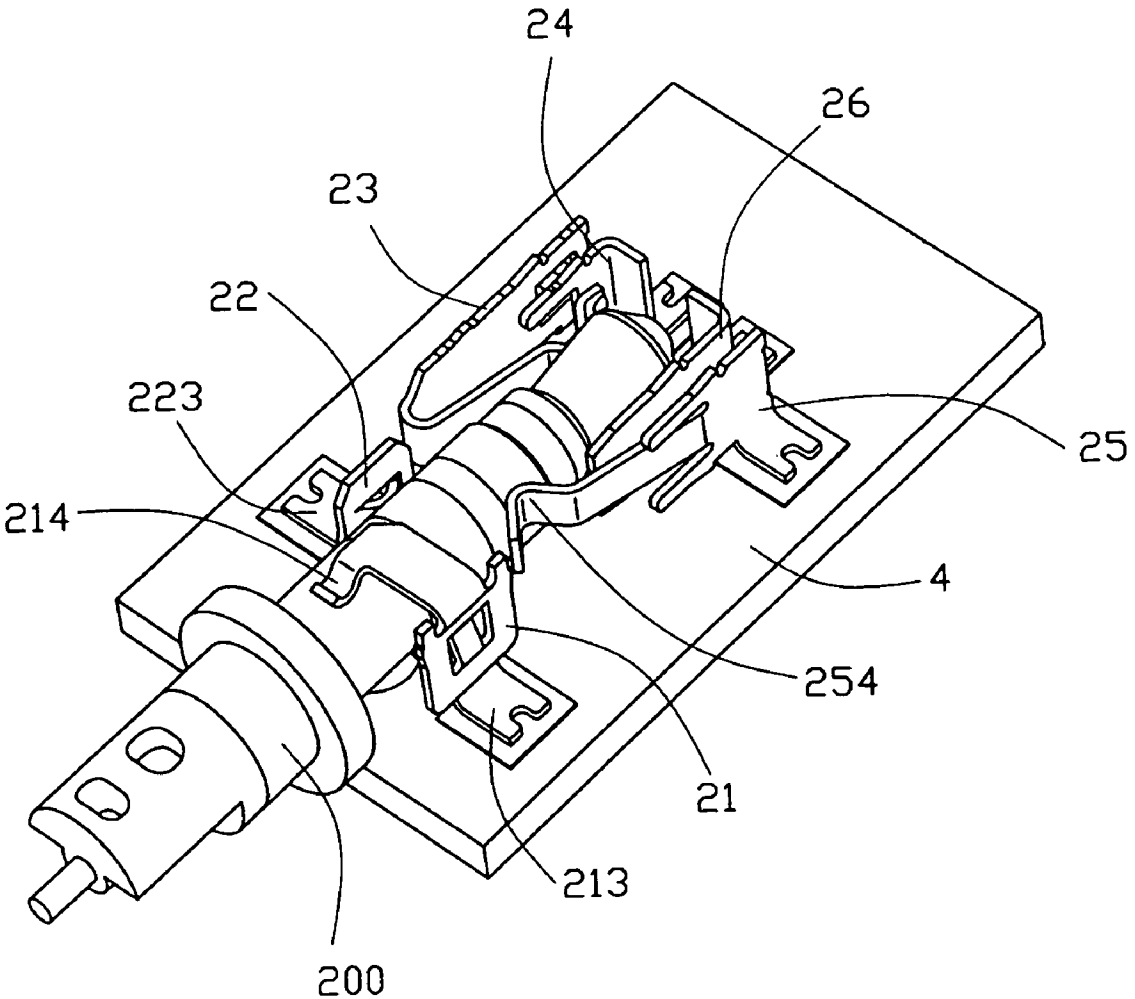
FIG. 5 is a perspective view of contacts mating with a corresponding plug inserted thereinto.

Referring to FIGS. 1 to 5, an electrical connector 100 according to the preferred embodiment is an audio jack connector mounted on a PCB 4 for mating with a corresponding plug 200 (shown in FIG. 5). The electrical connector 100 comprises an insulative housing 1 and a plurality of contacts 2 retained in the insulative housing 1. The contacts 2 include a first contact 21, a second contact 22, a first switch terminal group and a second switch terminal group.

The insulative housing 1 has a front face (not labeled) for engaging with the plug 200, a rectangular-shaped base 11 and a mating portion 12 extending forwardly from a front surface 110 of the base 11. The base 11 extends along a longitudinal direction. The mating portion 12 defines a receiving hole 10 extending inwardly through the base 11 in the longitudinal direction. The base 11 has a top wall 13, a mounting wall 14 opposite to the top wall 13, a pair of first and second side walls 15, 16 connecting the top and mounting walls 13, 14, and a rear face 17 opposite to the mating portion 12. The top wall 13 defines a L-shaped depression 131 communicating with the receiving hole 10. The mounting wall 14 is adapted for being mounted on the PCB 4. A first retaining groove 132 is formed vertically through the top and mounting walls 13, 14, wherein the first retaining groove 132 is in communication with the depression 131 for receiving the first contact 21. The mounting wall 14 defines a slot 141 extending from an intermediate position thereof and further extending forwardly and terminating at the front face. The slot 141 extends through the mounting wall 14 in another direction perpendicular to the longitudinal direction wherein the slot 141 is in communication with the receiving hole 10. Besides, the slot 141 extends along the longitudinal direction. A second retaining groove 142 is formed opposite to the first retaining groove 132 wherein the second retaining groove 142 communicates with the receiving hole 10 for receiving the second contact 22. The base 11 defines a pair of first and second slits 171, 172 extending inwardly from the rear face 17 and positioned at one side of the receiving hole 10 for receiving the first switch group. A pair of third and fourth slits 173, 174 are disposed inwardly from the rear face 17 at the other side of the receiving hole 10 of the base 11 for accommodating the second switch group. The first, second, third and fourth slits 171, 172, 173 and 174 are all in communication with the receiving hole 10.

The first contact 21 is used for transmitting signals and has a first stationary portion 211 retained in the first retaining groove 132, a L-shaped extending portion 212 perpendicular to the first stationary portion 211 and a first soldering tail 213. The extending portion 212 includes a first contact portion 214 extending into the receiving hole 10 for electrically engaging with the corresponding plug 200.

The second contact 22 is used for transmitting signals too. The second contact 22 is L-shaped and has a second soldering tail 223 and a second stationary portion 221 received in the second retaining groove 142. The second stationary portion 221 has a second contact portion 224 extending into the receiving hole 10 for abutting against the plug 200.

The first switch group includes a first switch terminal 23 and a second switch terminal 24 for detachably engaging with the first switch terminal 23. The first switch terminal 23 comprises a first retaining section 231, an arm 232 extending forwardly and bending backwardly from the first retaining section 231, and a first tail section 233 perpendicular to the first retaining section 231. The arm 232 has an engaging section 234 for mating with the plug 200. The second switch terminal 24 has a second retaining section 241 received in the second slit 172 and a second tail section 243. The first switch group is normally open. In detail, the arm 232 of the first switch terminal 23 disengages from the second retaining section 241 before insertion of the plug 200. When the plug 200 is inserted into the receiving hole 10, the arm 232 is driven by the plug 200 to contact the second retaining section 241, thereby forming a first switch signal in the PCB 4.

The second switch group includes a third switch terminal 25 and a fourth switch terminal 26 for detachably engaging with the third switch terminal 25. The third switch terminal 25 comprises a third retaining section 251, a cantilever 252 extending forwardly from the third retaining section 251, and a third tail section 253 perpendicular to the third retaining section 251. The cantilever 252 has an engaging portion 254 for mating with the plug 200. The fourth switch terminal 26 has a fourth retaining section 261 received in the fourth slit 174 and a fourth tail section 262. The second switch group is normally close. In detail, the cantilever 252 of the third switch terminal 25 contacts the fourth retaining section 261 before insertion of the plug 200. When the plug 200 is inserted into the receiving hole 10, the cantilever 252 is driven by the plug 200 to be disengaged from the fourth retaining section 261, thereby forming a second switch signal in the PCB 4.

In assembly, the first and second contacts 21, 22 are attached to the insulative housing 1 from the top wall 13 and the mounting wall 14, respectively. The first and the second soldering tails 213, 223 extend beyond the first and second side walls 15, 16 respectively for being mounted on the PCB 4 through surface mounted technology (SMT). The first, second, third and fourth switch terminals 23, 24, 25 and 26 are inserted into the first, second, third and fourth slits 171, 172, 173 and 174, respectively. The soldering tails 213, 223 together with the first, second, third and fourth tail sections 233, 243, 253 and 263 extend beyond the insulative housing 1. The soldering tails 213, 223, the first, second, third and fourth tail sections 233, 243, 253 and 263 together with the mounting wall 14 are coplanar with one another to be surface mounted on the PCB 4.

Comparing with the prior art, the mounting wall 14 defines a slot 141 extending through the mating portion 12. The slot 141 can counteract a deformation of the insulative housing 1, thereby ensuring the soldering tails 213, 223 and other tail sections 233, 243, 253, 263 coplanar with one another when mounted to the PCB 4. As a result, the soldering characteristic of the electrical connector 100 in this configuration is improved.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector mounted on a printed circuit board (PCB) for mating with a plug, comprising:

an insulative housing comprising a base extending along a longitudinal direction and a mating portion protruding forwardly from a front surface of the base, the mating portion defining a receiving hole extending into the base for receiving the plug, the base having a mounting wall facing to the PCB with a slot defined therethrough in a direction perpendicular to the longitudinal direction, the slot extending forwardly from a position on the mounting wall and through the mating portion, the slot extending substantially along the longitudinal direction and being in communication with the receiving hole; and a plurality of contacts retained in the base, the contacts having a plurality of contact portions extending into the receiving hole and a plurality of soldering portions extending beyond the mounting wall to be surface mounted on the PCB.

2. The electrical connector according to claim 1, wherein the slot extends from an intermediate position on the mounting wall.

3. The electrical connector according to claim 1, wherein the insulative housing has a top wall opposite to the mounting wall with a depression defined therein, one contact portion extending into the receiving hole through the depression.

4. The electrical connector according to claim 1, wherein the soldering portions are coplanar with one another.

5. The electrical connector according to claim 1, wherein the soldering portions are coplanar with the mounting wall.

6. The electrical connector according to claim 1, wherein the insulative housing has a rear face opposite to the mating portion, the base defining a pair of slits extending inwardly from the rear face and being positioned on a side of the receiving hole.

7. The electrical connector according to claim 6, wherein the contacts comprise a pair of switch terminals respectively received in the pair of slits.

8. The electrical connector according to claim 7, wherein the base defines another pair of slits extending inwardly from the rear face and being positioned on another side of the receiving hole, the contacts having another pair of switch terminals received in the another pair of slits, the another pair of switch terminals detachably engaging with each other.

9. An electrical connector assembly comprising:

a printed circuit board (PCB);

an electrical connector mounted on the PCB, said connector comprising:

an insulative housing having a base extending along an axial direction, the insulative housing defining a front face, a receiving hole extending from the front face backwardly along the an axial direction and a mounting surface facing to the PCB, a slot extending from a front face rearwardly not only in said axial direction along the housing with a predetermined distance but also in a radial direction through said housing till the receiving hole so as to provide deformability thereof;

a plurality of contacts retained in the insulative housing with a plurality of contact portions extending into the receiving hole; and a tubular mating portion extending from a front face of the base and defining essentially a circular cross-section; wherein a portion of a bottom region of said circular cross-section is removed so as to form a flattered face thereof, and said slot extends through said bottom section in said radial direction.

10. The assembly as claimed in claim 9, wherein the slot is essentially hidden except from the front face.

11. The assembly as claimed in claim 10, wherein the slot is located in the mounting surface.

12. The assembly as claimed in claim 9, wherein said flattened face is essentially coplanar with said mounting surface of the housing.

13. The assembly as claimed in claim 9, wherein said slot is essentially located in a vertical diametrical line of said circular cross-section.

14. The assembly as claimed in claim 9, wherein a top region of said circular cross-section is removed to form another flattened face.

15. The assembly as claimed in claim 14, wherein said another flattened face is essentially coplanar with a top face of the base.

16. An electrical connector assembly comprising:

a printed circuit board (PCB);

an electrical connector mounted on the PCB, said connector comprising:

an insulative housing having a base extending along an axial direction, the insulative housing defining a front face, a receiving hole extending from the front face backwardly along the an axial direction and a mounting surface facing to the PCB, a slot extending from a front face rearwardly not only in said axial direction along the housing with a predetermined distance but also in a radial direction through said housing till the receiving hole so as to provide deformability thereof;

a plurality of contacts retained in the insulative housing with a plurality of contact portions extending into the receiving hole; and a tubular mating portion extending from a front face of the base and defining essentially a circular cross-section having a circumference; wherein one of said contacts defines a contacting section is located at a first position of said circumference, and said slot is located at a second position of the circumference under a condition that said first position and said second position are diametrically opposite to each other.

17. The assembly as claimed in claim 16, wherein said slot and said contacting section are essentially located in a vertical diametrical line of said circular cross-section.

18. The assembly as claimed in claim 16, wherein a bottom portion of said circular cross-section is removed to form a flattened face which is essentially coplanar with said mounting surface of the housing.

19. The assembly as claimed in claim 18, wherein a top portion of said circular cross-section is removed to form another flattened face.

20. The assembly as claimed in claim 19, wherein said another flattened face is coplanar with a top face of the base.

* * * * *